United States Patent [19]

Pleass

[11] 4,221,550

[45] Sep. 9, 1980

[54] FLUID PUMP

[75] Inventor: Charles M. Pleass, Havre De Grace, Md.

[73] Assignee: University of Delaware, Newark, Del.

[21] Appl. No.: 44,540

[22] Filed: Jun. 1, 1979

Related U.S. Application Data

[63] Continuation-in-part of Ser. No. 909,978, May 26, 1978, abandoned.

[51] Int. Cl.[3] ..... F04B 43/00

[52] U.S. Cl. ..... 417/437

[58] Field of Search ..... 417/437, 479, 555, 518; 92/89, 90; 4/255

[56] References Cited

U.S. PATENT DOCUMENTS

| | | | |
|---|---|---|---|
| 2,765,751 | 10/1956 | Osius | 92/90 |
| 2,913,991 | 11/1959 | Dolza et al. | 92/90 |
| 2,929,332 | 3/1960 | Pierce | 417/479 |
| 3,021,793 | 2/1962 | Bolstad | 417/555 |
| 3,058,431 | 10/1962 | Eddy | 417/518 |
| 3,270,684 | 9/1966 | Pasquali et al. | 92/90 |
| 3,945,770 | 3/1976 | Welker | 417/479 |

FOREIGN PATENT DOCUMENTS

| | | | |
|---|---|---|---|
| 1906808 | 9/1969 | Fed. Rep. of Germany | 417/437 |
| 97627 | 11/1960 | Netherlands | 417/479 |
| 1152027 | 7/1966 | United Kingdom | 417/437 |

*Primary Examiner*—Edward L. Roberts

[57] ABSTRACT

A fluid pump wherein the pumping action is created by reciprocating forces applied to an unattached block, such as a ball, of elastically deformable material in a cavity, such as a cylinder. The block effects the pumping by defining a fluid pumping enclosure in said cavity, the cavity being additionally provided with means effecting the deformation of said block during said reciprocatory force cycle, thereby storing energy which is advantageously recovered in the pump intake stroke.

9 Claims, 7 Drawing Figures

FLUID PUMP

The Government of the United States has rights to this invention pursuant to Grant No. 04-6-158-44025 of the Department of Commerce.

RELATED APPLICATION

This Application is a continuation-in-part of Application Ser. No. 909,978 filed May 26, 1978, now abandoned, and is substituted therefor.

BACKGROUND OF THE INVENTION

This invention relates to a fluid pump and more particularly to a high pressure pump that can be used in the pumping of sea water.

Sea water contains impurities that are abrasive and chemically corrosive and tend to effect considerable wear of pumps. The effects of wear are most noticeable in high pressure pumps. Repairs and replacement of such prior art pumps are frequent and expensive.

OBJECTS OF THE INVENTION

It is an object of this invention to provide a relatively inexpensive high pressure pump. It is a further object to provide a seal within said pump having an exceptionally long lifetime, operated with sea water or the equivalent. Another object is to provide a pump that can be easily repaired. A further object is to provide a high pressure pump which can be constructed entirely of organic materials. Another object is to provide a high pressure short stroke pump. Other objects will be apparent from the following description of the invention.

SUMMARY OF THE INVENTION

These objects are accomplished by the following invention which comprises providing the pumping action by applying reciprocating forces to an unattached sphere of elastically deformable material in a cavity. The sphere effects the pumping by creating a fluid pumping enclosure in said cavity and by having in said cavity enclosure means for effecting the deformation of said sphere as the sphere is forced against such means during the reciprocatory force cycle.

The unattached sphere should be free to move in the cavity to an extent limited by the position of the means for applying the force and the means for effecting the deformation of said sphere.

THE DRAWINGS

The invention can be better understood by reference to the partially schematic drawings in which.

DETAILED DESCRIPTION

Figure 1:
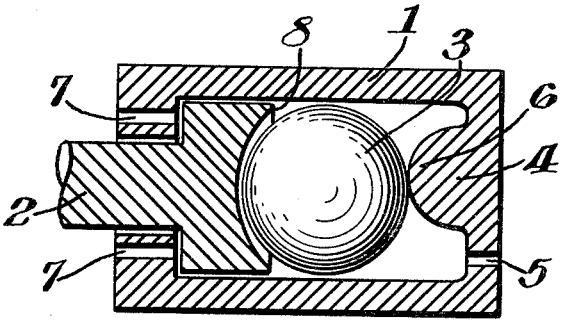
FIG. 1 is a sectional view of such a pump at the beginning of the pumping stroke wherein the sphere operates within a cylindrical cavity.
Figure 2:
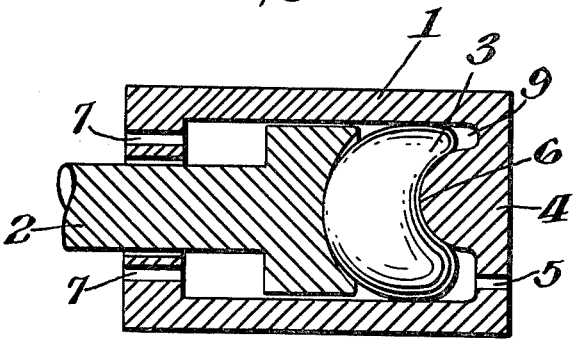
FIG. 2 is a sectional view of the pump of FIG. 1 at the end of the compression stroke.

One preferred form of the pump is shown in FIGS. 1 and 2. This pump has a cylinder 1, a piston 2, and a urethane elastomer (e.g., an Adiprene® L42) sphere or ball 3 that loosely fits in the cylinder at the point the piston 2 is furthest from the head 4 of the cylinder 1. The head 4 has a port 5 connected to an appropriate check valve assembly, not detailed herein, and a protrusion 6 toward the ball 3, the protrusion 6 being slightly off center of the head 4. Vents 7 are located in the end of the cylinder opposite the head 4. The piston 2 has a concave spherically shaped face 8 that is of slightly larger diameter than the ball 3 so as to freely release ball 3 at the end of the stroke.

During the compression stroke as shown in FIG. 2, the ball 3 is compressed against the protrusion 6 and first forms a seal against the wall of the cylinder 1 creating a fluid enclosure 9. As the piston 2 moves toward the head 4, the volume of this enclosure 9 is reduced forcing the fluid out of the pump through port 5. At the end of compression stroke the force driving the piston falls to zero, and the energy stored in the distorted Adiprene® ball forces the piston back, increasing the volume of the enclosure 9 and hence drawing fluid into the enclosure through port 5. This action continues until the ball is free of the cylinder wall and piston and hence free to rotate in the cylinder. Having the protrusion 6 off center of the head 4 assists in the rotation. The rotation of the ball tends to release trapped particles and present a different sealing surface during each stroke of the piston.

The pump of FIGS. 1 and 2 provides a short stroke single-acting high pressure pump where the compression of the fluid and the seal is dependent on the deformation of a relatively soft elastomeric unattached sphere. The seal is formed by the first microscopic distortion of the sphere and increases in area as the piston forces the sphere toward the head of the cylinder. The pumping action is occasioned by the deformation of the sphere into a cavity or enclosure 9 at the cylinder head. Force required to return the piston may be supplied in whole or in part by the elastic energy stored in the deformed sphere. The cavity or enclosure 9 can be of any shape, limited only by the requirements that (1) the cylinder head or any protrusion therein which causes deformation is so shaped that it will not puncture or cut the material of the sphere and (2) the head is not itself concavely spherical.

The sphere need not be made of Adiprene® L42 and can be either a composite or a homogeneous entity. For example, a homogeneous sphere of neoprene, natural rubber, or similar organic elastomer can be used. The sphere could also be a fluid-filled (e.g., water-filled) shell of neoprene or Adiprene® L100, polypropylene, polyvinyl chloride or similar polymer, or the shell can be filled with an organic polymer in solid or sponge form.

The unattached sphere may be capable of freely moving in the cavity when not under piston pressure or may be of a relatively close fit. The sealing surface and its lifetime may be extended by providing the opportunity for the sphere to move when it is in a relaxed position at the end of the refill cycle. In its simplest manifestation, this is done by constructing the sphere to be a loose fit in a cylinder. It will, therefore, fidget in those moments which precede the onset of the pumping stroke. Additional options include placing the protrusion in the cylinder head off center to give an initial off-axis impulse to the sphere as the pressure stroke begins. This will cause slight rotary motion. Another alternative is to prepare the dish on the piston head with its plane slightly offset from the plane at right angles to the major axis of the cylinder. This will also provide an off-center impulse.

Figure 3:
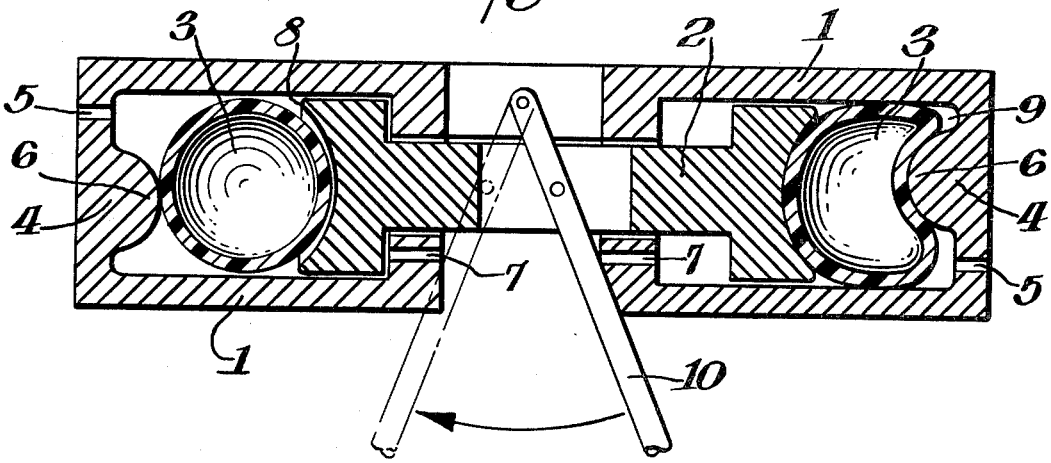
FIG. 3 is a sectional view of a pump wherein two pumps of the type of FIG. 1 are placed back to back to form a double-acting device.

Two pumps of the type described in FIG. 1 can be placed back-to-back in a cylinder to form a double-acting high pressure pump as shown in FIG. 3. In this modification the piston reciprocates along the axis of the cylinder, driven by an external mechanism 10, alternately compressing one or other of the spheres. In this modification the sphere is not required to provide all the force to return the piston after the compression stroke, and it may be constructed of materials which have less ability to store energy during elastic deformation, for example, a water-filled Adiprene® or polypropylene shell.

A multiplicity of these pumps may be staged to receive impulses from a crank shaft or suitably engineered cam, thus providing continuous high pressure fluid output at high volume. Such a modification would be similar to a multiple cylinder pump such as described in connection with the invention of U.S. Pat. No. 2,463,486 wherein two balls are used in place of the piston and connecting rod in each cylinder.

Figure 4:
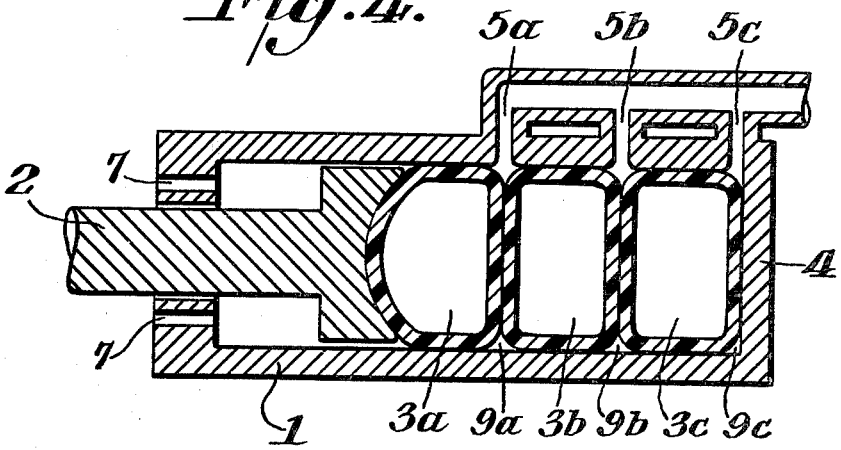
FIG. 4 is a sectional view of a pump using several spheres in series.

Two or more deformable spheres may be arranged together in a pumping device, either between high pressure ports in the cylinder wall as shown in FIG. 4, or in some other geometry which is beneficial to the specific engineering application. Where several spheres are arranged in this manner, these may be varied in elasticity and material of construction throughout the stack, in order to modify the pump characteristics.

In FIG. 4 the piston 2 is shown in the compression stroke and the cylinder 1 is of sufficient length to accommodate three elastomeric spheres 3*a*, 3*b*, and 3*c*. In the compression stroke, these spheres create three enclosures 9*a*, 9*b*, and 9*c* which decrease in volume during the compression stroke forcing fluid through ports 5*a*, 5*b*, and 5*c*, respectively. The head 4 of the cylinder 1 may be flat as shown and hence need not contain a protrusion such as 6 in FIG. 1. However, in the pump of FIG. 4 the volume of the enclosure 9*c* is only half that of 9*a* or 9*b*.

The means for effecting the deformation of the unattached sphere can be accomplished by the structure and shape of the head of the cavity as shown in FIGS. 1 and 2, or can be means separate from the head. The means can be deformable as well as nondeformable. This is indicated by the stacked deformable elements of FIG. 4.

In the above described pump design, an advantage is obtained by having the sphere slightly smaller in diameter than the cylinder so that it is free to rotate and fidget preceding the onset of the pumping stroke. Also, in all such pumps as illustrated by FIGS. 1 to 4, the volume of the fluid pumped is limited to the elastic deformation of the sphere. In order to overcome this latter limitation while retaining the advantage of fidget and rotation of the sphere, the pump shown in FIGS. 5A and 5B was designed.

Figure 5A:
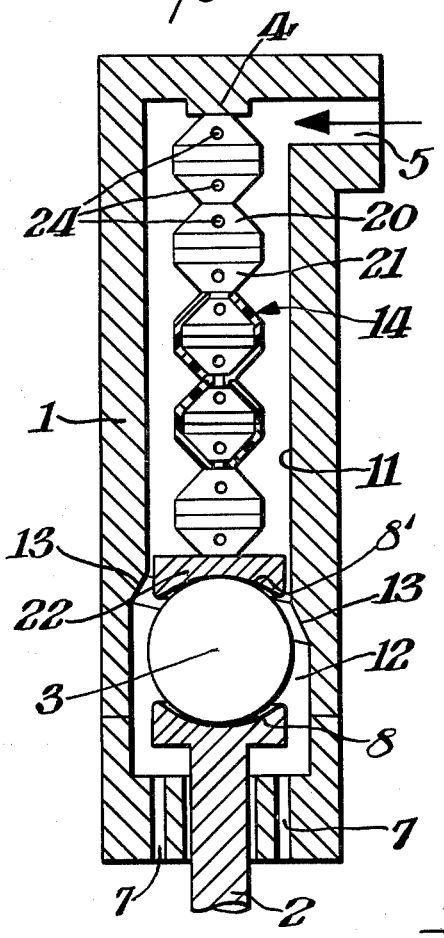
FIGS. 5A and 5B are sectional views of a long-stroke embodiment of the pump of this invention as to which FIG. 5A portrays operation near the end of the fluid intake stroke and FIG. 5B portrays operation near the end of the fluid delivery stroke.
Figure 5B:
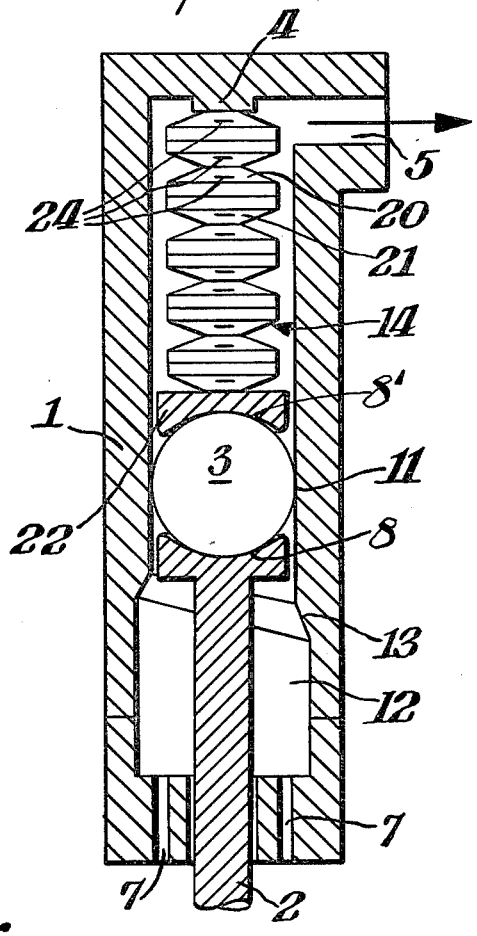

In FIG. 5A the unattached sphere 3 is deformed and used as a seal for the piston 2 in the pumping section 11 of the cylinder 1, while the sphere 3 is free to fidget and rotate and clear itself in the section 12 of cylinder 1. Section 11 of cylinder 1 has an internal diameter equal to or slightly smaller than the diameter of the sphere 3 while section 12 of cylinder 1 has an internal diameter larger than the sphere. The two sections are joined by a diagonally sloped lip 13 which causes a rotation of sphere 3 as it passes from one section to the other. When the pressure of the inflowing fluid is not sufficient to cause sphere 3 to return to section 12, a spring 14 and pusher plate 22 should be provided.

The primary function of pusher plate 22 is to provide sufficient pressure drop between its forward and trailing edge when piston 2 moves upward to speedily deform sphere 3 and thereby effect its seal against the wall of cylinder 1 and, therefore, pusher plate 22 must be sized accordingly. In addition, of course, the pusher plate constitutes a seat against which the outboard end of spring 14 bears. In this connection, spring 14 is a soft spring having a relatively low spring constant effective for maintaining contact between elements 22, 3 and 2 during the pump intake stroke.

Spring 14 is preferably fabricated from an elastomeric polymer as a plurality of pairs of frustoconical elements 20, 21 bonded base-to-base to form a multiplicity (in this instance five) of collapsible bulbs cemented or otherwise joined to neighboring bulbs in linear array, with the end bulbs attached, at the outboard end, to head 4, and at the inboard end to a pusher plate 22 having a concave spherically shaped face 8′ generally matching face 8 of piston 2. The bulbs are each provided with fluid pressure equalization ports 24 to vent fluid entrapped within the bulbs during the fluid delivery stroke depicted in FIG. 5B.

Again, as in the designs of FIGS. 1–4, port 5 is the pumped fluid port connected with a check valve not detailed whereas ports 7 are pressure equalization ports.

Figure 6:
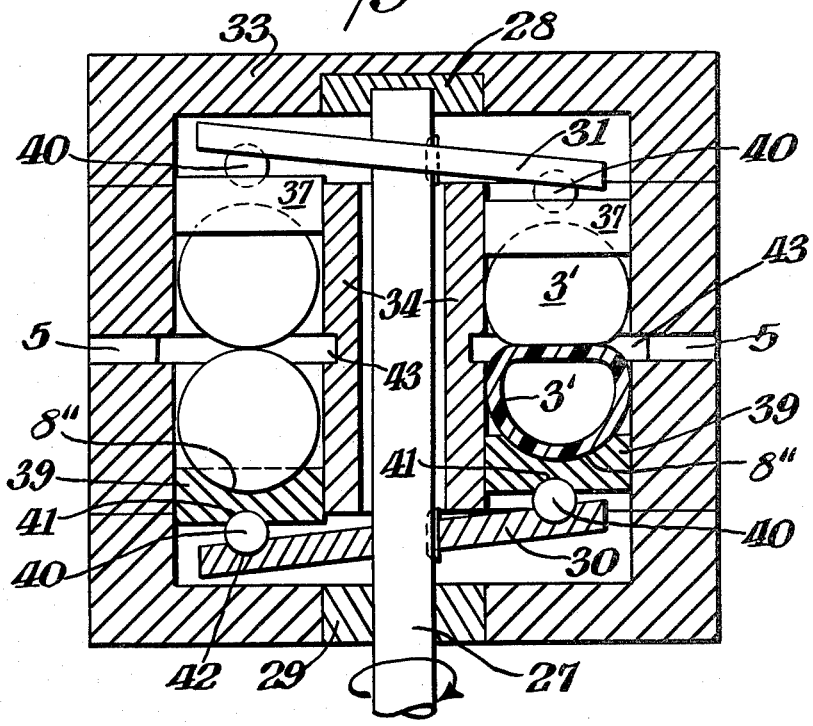
FIG. 6 is a sectional view of an embodiment of the pump utilizing a double swash plate as the reciprocatory force delivery mechanisms.

Referring to FIG. 6, there is shown a double swash plate embodiment of this invention wherein the power supply is furnished via a rotating drive shaft 27 journaled in bearings 28 and 29. Shaft 27 has keyed thereto first and second swash plates 30 and 31, respectively, each inclined at, typically, 7° to shaft 27 and oriented 180° opposite one another so that the swash plates are closest together at one point in shaft rotation, as shown at the right side of FIG. 6, and at maximum separation at the left side.

Housing 33 is fitted with a multiplicity of fixed pumping cylinders 34, typically four in number, disposed circumferentially of shaft 27 at 90° intervals, each provided with a pumped fluid port 5 connecting with individual check valves, not shown.

Each cylinder 34 is fitted with an upper piston 37 and a lower piston 39, each machined on its inside face with a concave seat 8″ within which are disposed the free opposed spheres 3′. Reciprocatory motion is transmitted to pistons 37 and 39 via rotatable balls 40 carried within spherical seats 41, against which the balls are biased by circular tracks 42 machined in the opposed swash plate faces.

Preferably, each cylinder 34 is provided at mid-length with an annular recess 43 serving as a plenum chamber for pumped fluid.

Pump delivery occurs when spheres 3′, 3′ are squeezed closest together, as depicted on the right side of FIG. 6 whereas fluid intake occurs during increasing separation of swash plates 30 and 31 as a result of elastic compression release of spheres 3′, 3′. Thus, there ensues a complete two-stroke pumping cycle for each cylinder 34 during each full revolution of shaft 27 and its swash plates 30 and 31.

Obviously, the opposed piston design, hereinbefore described, each piston provided with its own rotatable ball 3', so that pairs of balls 3', 3' impinge one against the other causing mutual deformation thereof, can be utilized as individual pumping units with a wide choice of drive options completely apart from the swash plate drive shown in FIG. 6.

Although the foregoing description has been directed specifically to a seawater pump, it will be apparent that the design is equally applicable to a broad variety of corrosive or erosive environments, including particularly, the chemical industry. In addition, the invention apparatus has all the attributes of a highly effective shock absorber for use in motor vehicles and this use of the pump is specifically contemplated.

While the invention has been disclosed herein in connection with certain embodiments and certain structural and procedural details, it is clear that changes, modifications or equivalents can be used by those skilled in the art; accordingly, such changes within the principles of the invention are intended to be included within the scope of the claims.

I claim:

1. A fluid pump having a piston and an encasement within which said piston is free to reciprocate wherein there is provided at least one unattached elastic resiliently deformable sphere between the head of said piston and the head of said encasement, means at the head of said encasement for effecting deformation of said sphere during the pumping stroke of said piston to thereby define a fluid enclosure that varies in volume with said pumping stroke, and a port communicating with said fluid enclosure for intake and discharge of pumped fluid.

2. A fluid pump according to claim 1 wherein said means for effecting deformation of said sphere is a smooth surface projection in the head of said encasement.

3. A fluid pump according to claim 2 wherein said projection is convexly shaped to an approximately hemispherical profile.

4. A fluid pump according to claim 2 wherein said projection is slightly off center at the head of said encasement.

5. A fluid pump according to claim 1 wherein said cylindrical encasement comprises a bore incorporating a pumping section having an internal diameter slightly smaller than that of said sphere, a recovery section in axial prolongation with said pumping section having an internal diameter somewhat greater than said sphere, wherein said sphere is free to rotate, and a diagonally sloped lip joining said pumping section and said recovery section.

6. A fluid pump according to claim 5 provided with a spring of stiffness sufficient to return said sphere to said recovery section during the refill stroke.

7. A fluid pump according to claim 6 provided with a pusher plate interposed between the outboard end of said spring and said sphere, said pusher plate having a diameter slightly smaller than the diameter of said pumping section.

8. A fluid pump according to claim 1 wherein said encasement is provided with two opposed pistons each provided with at least one unattached elastic resiliently deformable sphere, adjacent oppositely impelled spheres effectively constituting the head of said encasement for effecting sphere deformation during the pumping stroke of said piston to thereby define said fluid enclosure that varies in volume with said pumping stroke, and a port communicating with said fluid enclosure for intake and discharge of pumped fluid.

9. A fluid pump according to claim 8 wherein the reciprocatory cycle of said two opposed pistons is effected by rotatably driven swash plates, fixed on a common shaft substantially 180° out of phase one with the other.

* * * * *